United States Patent [19]

Bruno

[11] 4,364,527

[45] Dec. 21, 1982

[54] TENSION TAKE-UP AND SPEED CONTROL

[75] Inventor: Gerald R. Bruno, Paterson, N.J.

[73] Assignee: Progressive Machine Company, Inc., Paterson, N.J.

[21] Appl. No.: 264,001

[22] Filed: May 13, 1981

[51] Int. Cl.[3] ..... B65H 17/02; B65H 25/02

[52] U.S. Cl. ..... 242/75.51; 226/44; 242/45

[58] Field of Search ..... 226/44, 45, 24; 242/45, 242/75.51, 75.5, 75.52, 75.53, 75.42, 75.43, 75.44, 156, 156.2, 147 R, 75, 75.3

[56] References Cited

U.S. PATENT DOCUMENTS

| | | | |
|---|---|---|---|
| 1,158,432 | 11/1915 | Benoit | 242/45 |
| 1,343,910 | 6/1920 | Evans | 242/75.51 |
| 2,263,278 | 11/1941 | Senna | 242/45 |
| 2,345,765 | 4/1944 | Michel | 242/75.51 X |
| 2,474,620 | 6/1949 | Fath | 242/75.51 |
| 3,059,869 | 10/1962 | Ash | 242/45 |
| 3,587,959 | 6/1971 | Glover | 226/44 X |
| 3,667,664 | 6/1972 | Schroeder | 226/44 X |
| 3,807,613 | 4/1974 | Holm | 226/44 X |
| 3,822,832 | 7/1974 | Torii et al. | 242/45 |
| 3,826,442 | 7/1974 | Bethke | 242/75.5 |
| 4,012,003 | 3/1977 | Cochran et al. | 242/75.51 X |

*Primary Examiner*—Stanley N. Gilreath

*Attorney, Agent, or Firm*—Lerner, David, Littenberg & Samuel

[57] ABSTRACT

Apparatus for controlling the tension and predetermined rate of movement of a continuous strip of elongated material being fed to and/or withdrawn from a processing station for processing at a predetermined processing rate is disclosed. The apparatus includes a pair of pivotable control arms, in which the first control arm is pivotable about a fixed pivot point and the second control arm is pivotable about the end of the first control arm, a spring between the two control arms whereby upon pivoting of the second control arm the spring transmits only a portion of the movement of that arm to the first control arm, and a speed controller for controlling the predetermined rate of movement of the strip in response to movement of the first control arm.

23 Claims, 4 Drawing Figures

TENSION TAKE-UP AND SPEED CONTROL

FIELD OF THE INVENTION

The present invention relates to tension control mechanisms. More particularly, the present invention relates to control arms for relieving the tension in a strip of elongated material. Still more particularly, the present invention relates to control arms for regulating the speed of supply of a strip of elongated material to a processing station, and/or the speed of take-up of a strip of elongated material from a processing station.

BACKGROUND OF THE INVENTION

The use of various control arms and tension control mechanisms is quite well known for a number of applications. These devices are generally employed in order to control the speed of supply of various materials and/or to act as a take-up mechanism when slack develops between various processing stations and the like. The particular environments in which these devices may be used are quite numerous, as are the variety of these devices which are so employed.

As an example of such a tensioning and control system is that shown in U.S. Pat. No. 1,343,910 to Evans. In this patent a rheostat is controlled by the speed with which the supply strip is drawn into the processing station, and the rheostat in turn controls the speed at which the supply strip is unwound from its feed station. In addition, the initial activation of the rheostat is in turn controlled by the spring mechanisms 8 and 9 shown therein.

A similar type of speed control and tension mechanism is shown in U.S. Pat. No. 3,667,664 to Schroeder. In this mechanism deflection of a lever 6 caused by alterations in the tension in the supply strip is used to actuate a drive motor for the feed rollers. In particular, a potentiometer 22 can be employed to provide a signal for motor speed control purposes. Similar such devices are also shown in U.S. Pat. No. 2,474,620 to Fath, U.S. Pat. No. 2,345,765 to Michel, and U.S. Pat. No. 3,807,613 to Holm.

While a number of these devices also effect uniform tensioning of the continuous supply strip, there are also several other types of devices which have been utilized exclusively for such purposes. These include devices such as those shown in U.S. Pat. No. 3,826,442 to Bethke, in which the tension in an envelope machine for continuously supplying web material is sensed between a pair of rollers 46 and 48, and by means of a tension sensing roll 50, which pivots in response thereto so as to maintain uniform tension in the web. In addition, U.S. Pat. No. 1,158,432 to Benoit discloses a system for uniform tensioning in winding machines which employs a lever 18 pivoted about a bracket 26 and in which there are springs located between the lever and the bracket as well as on drum 26 to the roll 16 about which the thread being fed in that case is wound.

One specific environment, however, which raises particularly troublesome problems with respect to both tensioning and speed control is that where a continuous web is being fed to or from a processing station which effects an intermittent interruption of the feed thereto, such as various punch presses and the like. One mechanism which is employed in this general type of environment is that of U.S. Pat. No. 3,904,145 to Steinberger et al, which however relates to a copying machine in which the motor for the take-up reel 18 is controlled by means of braking of the supply strip between rollers 14 and 17.

In such an environment, where the continuous strip of material such as a metallic strip is being fed to or rereeled from such an apparatus, the strip is subject to violent initiation and termination of motion, on a continuous basis. At the same time, this same material is normally being continuously fed from a feed source, and/or being continuously rereeled onto a take-up reel. In order to operate in connection with such punch presses and like it is therefore necessary that a minimum degree of tension be applied to the strip in a reverse direction, i.e., so as to prevent perfect feeding and registration of the strip in the processing station where that is required. On the other hand, if there is too little tension on the strip problems of over-feeding may generally occur, with similar negative results.

In such environments single arm bars and the like, similar to those shown in some of the references discussed above, have generally been employed. These, however, are unsatisfactory in that they directly translate these changes in tension in the supply strip into changes in the speed of the unreeling or rereeling mechanism, which then occur far too rapidly. This generally results in excessive tension being imparted to the supply strip. Furthermore, because continuous cycling of the motor driving the unreeling or rereeling mechanism then occurs, large amounts of power are necessary in order to obtain such rapid acceleration and deceleration thereof, and the drive mechanism itself can become damaged or destroyed.

SUMMARY OF THE INVENTION

In accordance with the present invention, apparatus for controlling the tension and predetermined rate of movement of a continuous strip of elongated material being fed to or withdrawn from a processing station for processing at a predetermined processing rate has now been discovered. In particular, such apparatus includes a first pivotable control arm having first and second ends, the first end being pivotable about a fixed pivot point, a second pivotable control arm having first and second ends, the first end thereof being pivotably connected to the second end of the first pivotable control arm, and the second end thereof being movable in response to variations in the difference between the predetermined processing rate and the predetermined rate of movement of the continuous strip, biasing means interposed between the first and second pivotable control arms so that upon pivoting of the second control arm about the second end of the first control arm the biasing means transmits only a portion of the movement of the second control arm to the first control arm, and speed control means for controlling the predetermined rate of movement of the strip in response to movement of the first pivotable control arm.

In accordance with a preferred embodiment of the apparatus of the present invention, the biasing means is adapted to urge the second pivotable control towards the plane of the first pivotable control arm. Preferably, the second pivotable control arm includes material contact means located at its second end and adapted to contact the strip of elongated material and to transmit variations in the difference between the predetermined processing rate and the predetermined rate of movement of the strip into movement of the second pivotable control arm.

In accordance with a preferred embodiment of the apparatus of the present invention, dampener means are included for dampening the pivoting of the first pivotable control arm about the fixed pivot point. Preferably, the dampener means substantially retards pivoting of the first pivotable control arm about the fixed pivot point in a first direction, but permits pivoting of the first pivotable control arm about the fixed pivot point in a second direction substantially freely. Preferably the first direction is towards the strip of elongated material.

In accordance with a preferred embodiment of the apparatus of the present invention, the predetermined processing rate comprises an intermittent rate, while the strip of elongated material is continuously fed or withdrawn from the processing station. The strip of elongated material can comprise either a metallic or plastic strip, and the processing station is preferably a punch press.

In accordance with another embodiment of the apparatus of the present invention, the second end of the second pivotable control arm includes an axle projecting therefrom, and the material contact means includes a roller which is rotatable about that axle. Preferably, roller guide means are also provided for maintaining the strip of elongated material in contact with the roller, and the roller guide preferably has a U-shaped configuration, including a pair of arms and a central portion, so that these arms can be connected to the axle on either side of the roller and the strip of elongated material can then be maintained in contact with the roller by means of the central portion of the U-shaped member bearing thereagainst.

In accordance with another embodiment of the apparatus of the present invention, pivot means are provided including a collar and a stem, in which the collar is connected to the first end of the second pivotable control arm and the stem is pivotable about the second end of the first pivotable control arm, and the biasing means is interconnected between the stem and to the second end of the first pivotable control arm.

In accordance with a preferred embodiment of the apparatus of the present invention, the biasing means is a spring, and preferably a coiled tension spring. Preferably, one end of the coiled tension spring is affixed to the stem of the pivot member, the second end of the coiled tension spring is affixed to the second end of the first pivotable control arm, and the central portion of the coiled tension spring is wound about the stem portion of the pivot member.

In accordance with another embodiment of the apparatus of the present invention, the second pivotable control arm is pivotable about the second end of the first pivotable control arm in a first direction so as to produce an angular displacement therebetween, and the apparatus includes stop means for preventing the second control arm from pivoting about the second end of the first control arm in a second direction opposite to the first direction in which the angular displacement approaches an angle of 0°. Preferably, a finger is employed for these purposes. The finger can project from the second control arm and contact the first control arm as the angular displacement approaches 0° so as to prevent further pivoting of the second control arm about the first control arm.

In accordance with a preferred embodiment of the apparatus of the present invention, the continuous strip is being fed from a feed station to the processing station at the predetermined rate of movement, the feed station includes a rotatable feed reel, and the speed control means includes a motor for rotating the feed reel. This apparatus includes a potentiometer for controlling the speed of the motor, and potentiometer control means for controlling the output of the potentiometer in response to pivoting of the first control arm. The potentiometer control means preferably includes a core whose first end is affixed to the second end of the first control arm for rotation upon pivoting of the first control arm, and whose second end is adapted to control the output of the potentiometer upon its rotation.

BRIEF DESCRIPTION OF THE DRAWINGS

The apparatus in accordance with the present invention can be more fully understood with specific reference to the drawings, in which.

DETAILED DESCRIPTION

Figure 1:
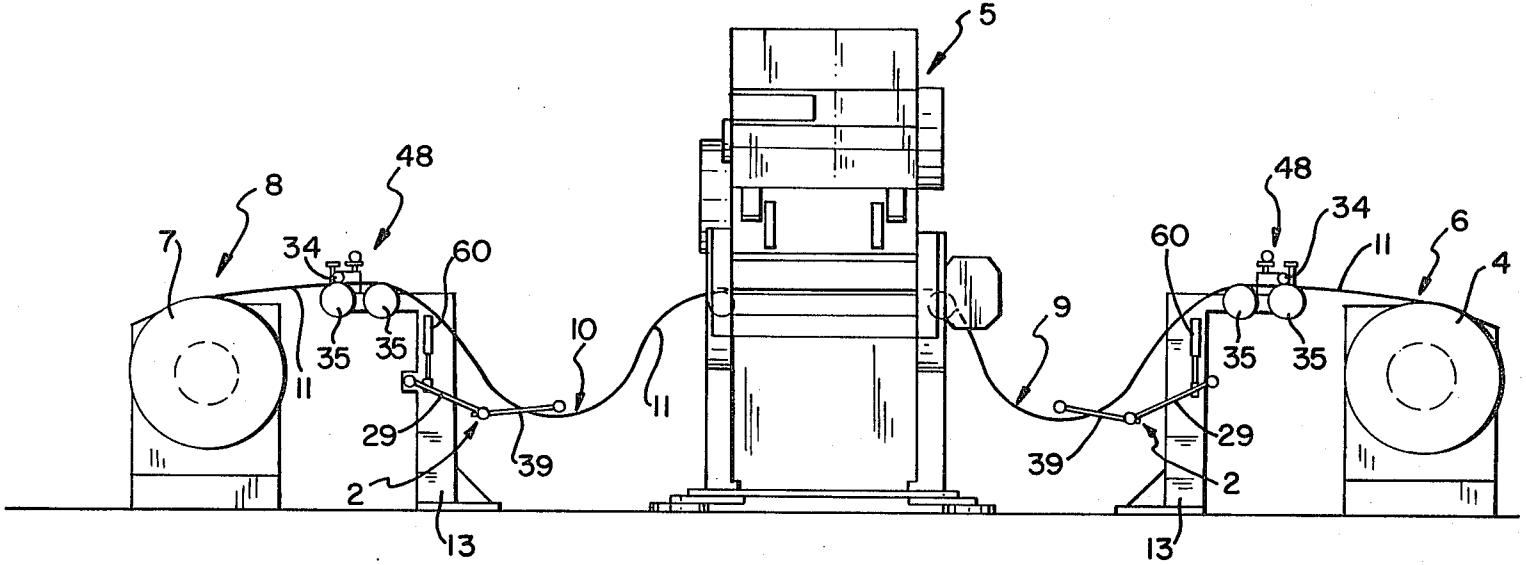
FIG. 1 is a side, elevational, perspective, partially schematic view of a process utilizing the apparatus of the present invention used in connection with both the feed to and withdrawal from a processing station, which in this case includes a punch press.

Referring specifically to the figures, in which like numerals refer to like portions thereof, the control arm apparatus of the present invention is generally referred to by the numeral 2. As shown in FIG. 1, such a control arm 2 can be employed in the particular environment shown therein, but as will be evident from the following discussion, it can also be employed in a number of related environments. In the case shown in FIG. 1, however, it is being employed both between a feed reel 4 at feed station 6 and a processing station 5, such as the punch press represented in FIG. 1, and between the take-up reel 7 at take-up station 8 and processing station 5. In this manner, control mechanism 2 operates to maintain or control the size of material loops 9 and 10 which form in a strip of elongated material 11, which is being fed through this system, i.e., from stations 6 to 5, and 5 to 7, respectively, and to control the speed of the motors (not shown in FIG. 1) which control the rotational speed of the feed reel 4 and of the take-up reel 7. This control function is in turn responsive to alterations in the speed of the strip, which relates directly to the size of loops 9 and 10. That is, during normal operation, variations will occur in the differences between the speed of the strip, as determined by the rate of rotation of either the feed reel 4 or the take-up reel 7, and the predetermined processing speed of the strip at processing station 5. Therefore, the size of loops 9 and 10 will tend to vary, as will the tension therein.

As will become apparent, the predetermined processing speed at the processing station 5 will determine the rate at which the continuous strip both enters and leaves processing station 5. As indicated above, some of the most severe operational problems occur in connection with apparatus, such as punch presses, which operate intermittently, i.e., with a stop-and-start motion of the continuous strip travelling through the processing station 5. As the size of the loops 9 and 10 is reduced, there will be a tendency for the tension in the strip of material 11 to increase. Thus, a force tending to prevent the smooth entry of the strip into the processing station 5 will be applied thereto, and/or a force tending to pull the strip out of the processing station 5 towards the take-up reel 7 will be created. On the other hand, the loops 9 and 10 can also become too large, in which case they may contact the floor or other machinery, etc. The purpose of the control mechanisms 2 of this invention is to eliminate these problems, on either side of the processing station.

Figures 2, 3, 4:
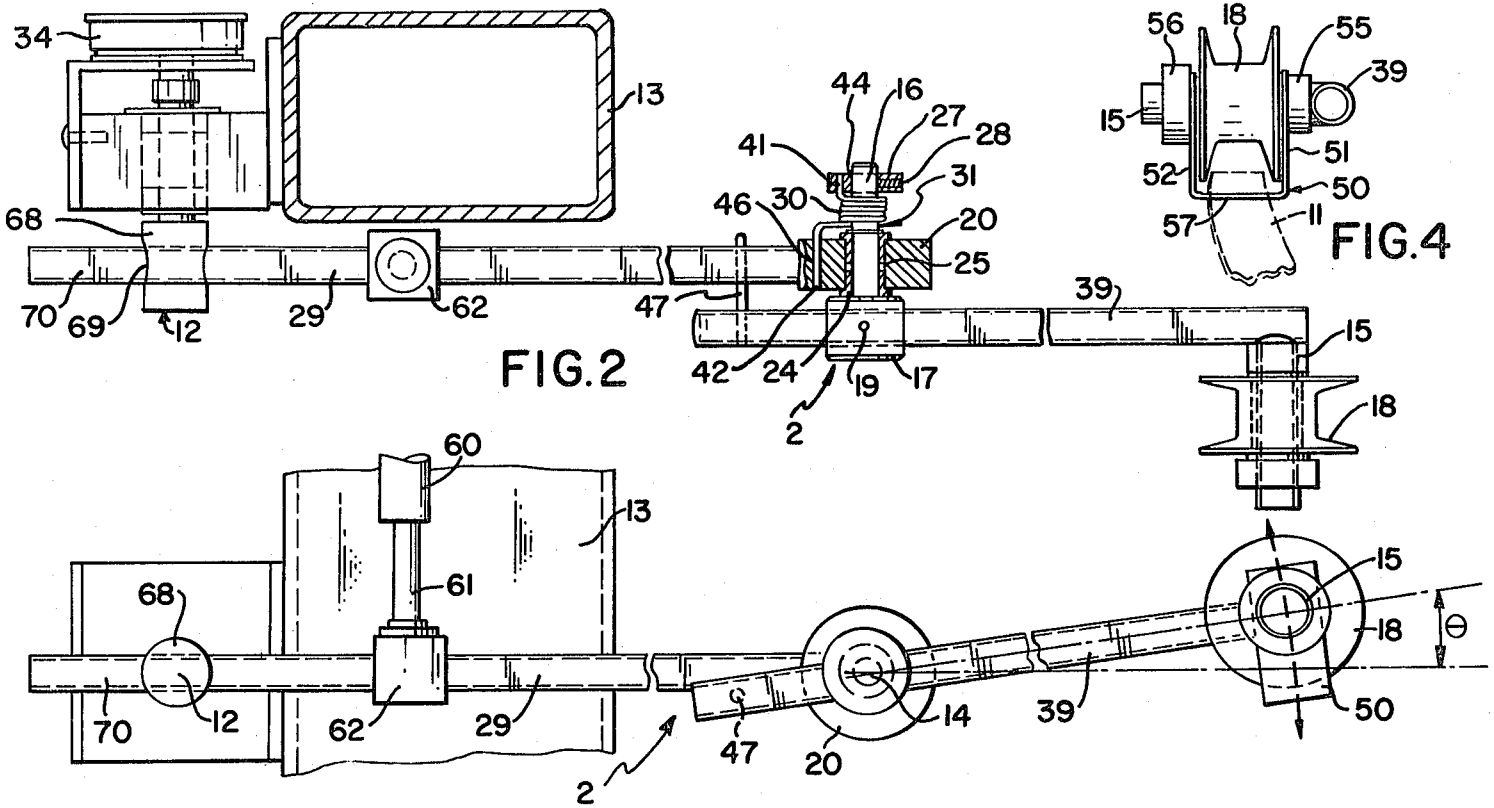
FIG. 2 is a top, elevational, partially sectional view of the control arm apparatus of the present invention.
FIG. 3 is a side, elevational, partially sectional view of the control arm apparatus of the present invention.
FIG. 4 is a front, elevational view of a portion of the control arm apparatus of the present invention.

Control mechanism 2 can be more fully understood with reference to FIGS. 2–4 hereof. In particular, a first control arm 29 pivots about a fixed point 12, that is, a point which is fixed with respect to upstanding member 13. A second control arm 39 is pivotable about point 14, i.e., with respect to the lower end of the first control arm 29. At the lower end of the second control arm 39, which has an L-shaped configuration including a short leg or axle 15, is a roller 18, which is rotatable about axle 15. It is this roller 18 which contacts the continuous strip 11 (as shown in phantom view in FIG. 4), and which is thus caused to rotate about pivot point 14 in either a clockwise or counterclockwise direction, as shown by the arrows in FIG. 3. Again, this is caused by variations in the size, position, and tension of the loops (9 or 10) in strip 11.

The pivoting of the second control arm 39 about pivot point 14 is effected in the following manner: A stud or pivot pin 31 is provided, including a stem portion 16 and a collar portion 17. Collar portion 17 surrounds a portion near the upper end of the second control arm 39, and may be affixed thereto such as by means of a screw 19, whose head can be seen in FIG. 2, and which extends through corresponding apertures in the collar portion 17 and the control arm 39, respectively. In this manner, pivoting of the second control arm 39 about pivot point 14 causes corresponding rotation of the stem portion 16 of the stud or pivot pin 31. The stem portion 16 extends through the lower end of the first control arm 29, which has a generally annular end portion 20 through which stem portion 16 extends. A bushing 24 is placed within the aperture 25 created within annular portion 20 at the lower end of control arm 29, so that the stem portion 16 can be inserted through bushing 24 for relative rotation therewithin. Stem portion 16 is fixed in position by means of a collar 27, which may be held in place by means of a set screw 28 extending therethrough and bearing against stem portion 16 as shown therein. A coiled tension spring 30 is wound about the portion of stem 16 which is located between the first control arm 29 and the collar 27, as shown. Ends 41 and 42 of the coiled tension spring 30 are affixed to the collar 27 and to the annular portion 20 at the end of the first control arm 29, respectively. This is accomplished by means of inserting ends 41 and 42 of spring 30 into corresponding apertures 44 in collar 27, and aperture 46 in the annular portion 20, respectively. In this manner, the spring 30 tends to urge the two control arms 29 and 39 into a substantially linear configuration, i.e., so as to reduce or eliminate the angle of displacement $\theta$ therebetween. That is, tension spring 30 urges the stem portion 16 to rotate in a clockwise direction, as shown in FIG. 3, and causes the second control arm 29 to rotate in a counterclockwise direction.

It is thus noted that an increase in the processing speed of processing station 5 or a decrease in the speed of the feed reel 4 will cause a reduction in the size of loop 9 in the supply strip 11 (i.e., on the feed side of processing station 5) the roller 18 at the end of the second control arm 39 is urged upwardly, or in a clockwise direction (as shown in FIG. 1), or in this case against the force of the tension in spring 30. On the other hand, an increase in the size of loop 9 forces the roller 18 downwardly, or in a counterclockwise direction. In this case, however, as the two control arms 29 and 39 approach a common plane, or as $\theta$ approaches 0°, rotation of the second control arm 39 is limited by the approach of finger 47 towards the lower surface of the first control arm 29. At that point, if there is any further counterclockwise rotation of the second control arm 39, such motion will be transmitted to the first control arm 29 directly through the finger 47, instead of through the tension spring 30.

As is shown most clearly in FIG. 4, the supply strip 11 is maintained in contact with roller 18 by means of a U-shaped bracket 50. The U-shaped bracket 50 includes a pair of arms 51 and 52, each including an aperture corresponding to the leg 15 projecting from the second control arm 39, i.e., on either side of roller 18. These arms 51 and 52 are held in position by means of collars 55 and 56 on either side thereof. The supply strip 11 is thus maintained between the roller 18 and the central portion 57 of U-shaped member 50.

The rotation of the first control arm 29 about pivot point 12 is also controlled by means of a dampener 60 affixed thereto. Thus, arm 61 extending from dampener 60 is affixed to the first control arm 29 by means of a collar 62, as is shown in FIGS. 2 and 3. In this manner, counterclockwise or upward motion of the first control arm 29 is permitted in a relatively unhindered fashion. However, downward or clockwise motion of the first control arm 29 is dampened, for the purposes more fully discussed below.

The upper end 70 of first control arm 29 is affixed to a rotatable core 68 by extending through an aperture 69 therein. Thus, rotation of the first control arm 29 causes a corresponding rotation of core 68 therewith. Core 68, in turn, is affixed to a potentiometer 34, so that such rotation alters the output from the potentiometer 34, which is electrically connected to a motor (not shown) for controlling the rate of rotation of either the feed reel 4 or the take-up reel 7.

The apparatus of the present invention thus operates as follows: The strip of elongated material 11 is both drawn into and fed from the processing station 5 intermittently. At the same time, strip 11 is being fed from feed reel 4 and taken up on take-up reel 7 continuously, at rates which are determined by the rate of the motors driving these feed and take-up reels. Each time strip 11 moves through the processing station 5, and/or its rate of travel increases in that or some other manner, the concomitant rapid acceleration of the strip 11 causes a corresponding upward or clockwise (as shown in FIG. 1) movement of the second control arm 39 of the control mechanism in the feed reel side of the processing station 5, and a downward or clockwise (again as shown in FIG. 1) movement of the second control arm 39 of the control mechanism on the take-up side of processing station 5. In each case, this occurs through contact of the strip 11 with roller 18, as maintained by U-shaped member 50. This upward motion of the control arm 39 on the feed reel side of the processing station 5 does not, however, directly translate itself into an increase in the rate of the motor controlling the rate of rotation of the feed reel 4, nor does the initial downward motion of the control arm 39 on the take-up side of processing station 5 directly translate itself into a decrease in the rate of the motor controlling the rate of rotation of the take-up reel 7 (and certainly not prior to contact of the finger 47 with the lower surface of the first control arm 29). Indeed, if it did, the advantages of the present invention would be lost, and the disadvantages of the prior art devices would result. Instead, much of this clockwise motion of both of these rollers 18, and control arms 39, is taken up by coiled tension springs 30. In each case, the rotation of control arm 39 causes a concomitant rotation of pivot or stem member 16, and its respective collar 27. This creates a torque at the end of the spring 30, which is affixed thereto. The corresponding torque thus placed on the other end of spring 30 which is affixed to the first control arm 29 is thus substantially reduced, and for slight movements of the second control arm 39 is substantially eliminated. At the same time, the downward pressure placed upon the supply strip 11 by rollers 18, keeps the tension on supply strip 11 relatively constant as it both enters into and exits from the processing station 5.

In the case of the control mechanism on the feed reel side of the processing station 5, the reduced rotational motion imparted to the first control arm 29 upon the upward motion of roller 18 causes a clockwise (again as shown in FIG. 1) rotation thereof.

This rotation of the first control arm 29 is substantially unaffected by means of dampener 60, which primarily exerts its dampening influence with respect to downward or counterclockwise rotation of the first control arm 29. In either case, the rotation of the first control arm 29, about fixed pivot 12, does result in some rotation of core 68 within potentiometer 34, which in turn directly controls the rate of the motor controlling the rate of rotation of the feed reel 4.

In the case of the control mechanism on the take-up side of the processing station 5, a similar discussion can be set forth. That is, when there is an increase in the speed of strip 11, and the size of loop 10 increases, there is a concomitant downward or clockwise motion of second control arm 39. This, as discussed above, results in a reduced degree of clockwise rotation of the first control arm 29, which in this case will be further dampened by means of dampener 60, i.e., it downward or clockwise motion is substantially retarded thereby. In any event, this reduced rotation then causes a rotation of core 68, thus effecting the output of potentiometer 34, and an increase in the speed of the motor controlling the rate of rotation of the take-up reel 7. On the other hand, when there is an increase in the tension in the strip 11 on the take-up side of the processing station, and the size of the loop 10 decreases, there is then a concomitant upward or counterclockwise motion of the second control arm 39. This then results in a reduced degree of upward or counterclockwise rotation of the first control arm 29, which in this case is now substantially undampened by means of dampener 60. This rotation causes a rotation of core 68, and therefore again affects the output of potentiometer 34, in this case causing a decrease in the speed of the motor controlling the rate of rotation of the take-up reel 7.

It is also noted that the apparatus shown in FIG. 1 includes a tensioning station 48 between the feed reel 4 and one control mechanism hereof, and between the take-up reel 7 and the other control mechanism hereof. In most instances, such a tensioning station 48 is not required on the feed side of processing station 5. The purpose of this conventional mechanism, however, is to apply tension to the continuous strip 11, i.e., between a pair of rollers 34 and 35. In this manner, it is assured that the strip being applied onto the take-up reel is maintained under tension while on these reels themselves, and is not loosely wound thereon.

With respect to the operation of the potentiometer 34, the above-noted discussion sets forth the manner in which the output thereof is altered so as to change the rotational speed of the feed and/or take-up reels. Their wiring and use is generally known to those of ordinary skill in the art, but it should be pointed out that the same potentiometers could be used on either the feed reel or take-up reel side of a processing station, with the exception that it would be necessary to reverse wire the potentiometer so as to obtain the desired result in terms of motor control for a given direction of rotation of the particular core therein.

The particular processing station 5 discussed above is not intended to constitute a limiting factor with respect to the use of the control mechanism hereof. It has been noted, however, that because these types of punch and die presses effect the rapid acceleration-deceleration cycles with respect to the continuous strips passing therethrough, that the most significant benefits of this invention can be realized in such an environment.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. Apparatus for controlling the tension and predetermined rate of movement of a continuous strip of elongated material being fed to or withdrawn from a processing station for processing at a predetermined processing rate, said apparatus comprising a first pivotable control arm having a first end and a second end, said first end of said first pivotable control arm being pivotable about a fixed pivot point, a second pivotable control arm having a first end and a second end, said first end of said second pivotable control arm being pivotably connected to said second end of said first pivotable control arm, and said second end of said second pivotable control arm being movable in response to variations in the difference between said predetermined processing rate and said predetermined rate of movement of said strip, biasing means interposed between said first and second pivotable control arms whereby upon pivoting of said second pivotable control arm about said second end of said first pivotable control arm said biasing means transmits only a portion of the movement of said second pivotable control arm to said first pivotable control arm, and speed control means for controlling said predetermined rate of movement of said strip in response to movement of said first pivotable control arm.

2. The apparatus of claim 1 wherein said biasing means urges said second pivotable control arm towards the plane of said first pivotable control arm.

3. The apparatus of claim 1 wherein said second pivotable control arm includes material contact means located at said second end thereof, said material contact means adapted to contact said strip of elongated material and to transmit said variations in the difference between said predetermined processing rate and said predetermined rate of movement of said strip into movement of said second pivotable control arm.

4. The apparatus of claim 3 wherein said second end of said second pivotable control arm includes axle means projecting therefrom, and wherein said material contact means comprises roller means rotatable about said axle means.

5. The apparatus of claim 4 wherein said material contact means includes roller guide means for maintaining said strip of elongated material in contact with said roller means.

6. The apparatus of claim 5 wherein said roller guide means comprises a U-shaped member including a pair of arms and a central portion, each of said pair of arms of said U-shaped member being connected to said axle means on either side of said roller means, whereby said supply of elongated material is maintained in contact with said roller means by means of said central portion of said U-shaped member bearing thereagainst.

7. The apparatus of claim 1 including pivot means, said pivot means including a collar portion and a stem portion, said collar portion of said pivot means being connected to said first end of said second pivotable control arm and said stem portion of said pivot means being pivotable about said second end of said first pivotable control arm, said biasing means being interconnected between said stem portion of said pivot means and said second end of said first pivotable control arm.

8. The apparatus of claims 1 or 7 wherein said biasing means comprises spring means.

9. The apparatus of claim 8 wherein said spring means comprises a coiled tension spring.

10. The apparatus of claim 7 wherein said collar portion of said pivot means comprises a cylindrical collar adapted to surround said second pivotable control arm and be affixed thereto.

11. The apparatus of claim 9 wherein said coiled tension spring includes a first end, a second end, and a central portion, said first end of said coiled tension spring being affixed to said stem portion of said pivot member, said second end of said coiled tension spring being affixed to said second end of said first pivotable control arm, and said central portion of said coiled tension spring being wound about said stem portion of said pivot member.

12. The apparatus of claim 1 wherein said second pivotable control arm is pivotable about said second end of said first pivotable control arm in a first direction so as to produce an angular displacement therebetween, and including stop means for preventing said second pivotable control arm from pivoting about said second end of said first pivotable control arm in a second direction opposite to said first direction in which said angular displacement approaches an angle of 0°.

13. The apparatus of claim 12 wherein said stop means comprises a finger projecting from said second pivotable control arm for contacting said first pivotable control arm as said angular displacement approaches 0° so as to prevent further pivoting of said second pivotable control arm about said first pivotable control arm.

14. The apparatus of claim 1 wherein said continuous strip of elongated material is being fed from a feed station to said processing station at said predetermined rate of movement, wherein said feed station includes a rotatable feed reel, and said speed control means comprises motor means for rotating said feed reel, potentiometer means for controlling the speed of said motor means, and potentiometer control means for controlling the output of said potentiometer in response to pivoting of said first pivotable control arm.

15. The apparatus of claim 14 wherein said potentiometer control means comprises core means including a first end and a second end, said first end of said core means being affixed to said second end of said first pivotable control arm for rotation upon pivoting of said first pivotable control arm, and said second end of core means being adapted to control said output of said potentiometer means upon rotation thereof.

16. The apparatus of claim 1 wherein said predetermined processing rate comprises an intermittent rate.

17. The apparatus of claim 1 wherein said strip of elongated material comprises a metallic strip.

18. The apparatus of claim 1 wherein said strip of elongated material comprises a plastic strip.

19. The apparatus of claim 1 wherein said processing station comprises a punch press.

20. The apparatus of claim 1 including dampener means for dampening the pivoting of said first pivotable control arm about said fixed pivot point.

21. The apparatus of claim 20 wherein said dampener means is affixed to said first pivotable control arm at a point located between said first and second ends thereof.

22. The apparatus of claim 20 wherein said dampener means substantially retards said pivoting of said first pivotable control arm about said fixed pivot point in a first direction, but permits said pivoting of said first pivotable control arm about said fixed pivot point in a second direction substantially freely.

23. The apparatus of claim 22 wherein said first direction is toward said strip of elongated material.

* * * * *